US010130989B2

(12) United States Patent
Tsutsumi

(10) Patent No.: US 10,130,989 B2
(45) Date of Patent: Nov. 20, 2018

(54) EVAPORATE PATTERN CASTING METHOD

(71) Applicant: Kobe Steel, Ltd., Hyogo (JP)

(72) Inventor: Kazuyuki Tsutsumi, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 15/519,995

(22) PCT Filed: Oct. 19, 2015

(86) PCT No.: PCT/JP2015/079474
§ 371 (c)(1),
(2) Date: Apr. 18, 2017

(87) PCT Pub. No.: WO2016/080132
PCT Pub. Date: May 26, 2016

(65) Prior Publication Data

US 2017/0312812 A1 Nov. 2, 2017

(30) Foreign Application Priority Data

Nov. 18, 2014 (JP) ..... 2014-233403

(51) Int. Cl.
*B22C 7/02* (2006.01)
*B22C 9/04* (2006.01)
*B22C 9/10* (2006.01)

(52) U.S. Cl.
CPC ..... *B22C 9/046* (2013.01); *B22C 7/023* (2013.01); *B22C 9/10* (2013.01)

(58) Field of Classification Search
CPC .. B22C 7/02; B22C 7/023; B22C 9/04; B22C 9/046; B22C 21/14
USPC ..... 164/34–36, 370, 397–400
See application file for complete search history.

(56) References Cited

U.S. PATENT DOCUMENTS 4,804,032 A * 2/1989 Wilkins ..... B22C 9/046 164/119
2012/0273151 A1 11/2012 Hirai et al.

FOREIGN PATENT DOCUMENTS

JP 2011-110577 A 6/2011

OTHER PUBLICATIONS

International Search Report issued in PCT/JP2015/079474; dated Jan. 12, 2016.

* cited by examiner

*Primary Examiner* — Kevin E Yoon
(74) *Attorney, Agent, or Firm* — Studebaker & Brackett PC

(57) ABSTRACT

An opening is provided in a foam pattern, and a coating agent is applied to the opening. The coating agent applied to the opening is taken as a beam having a sectional secondary moment I ($mm^4$), a vertical plate thickness h (mm), and a length L (mm). It is assumed that a volume of a cavity part in the foam pattern is V ($mm^3$), a bulk density of the casting sand filling the cavity part is ρs ($kg/mm^3$), a gravitational acceleration is g ($mm/sec^2$), a density of the melt is ρm ($kg/mm^3$), an angle of the opening with respect to a vertical direction is θ, and a transverse strength of the coating agent at the highest temperature during pouring of the melt is σb (MPa). A sectional shape of the opening, the angle θ of the opening, and the transverse strength σb of the coating agent are selected to satisfy the expression:

$$\sigma bI > V(\rho m - \rho s)g\{(hL/2)\sin\theta - \cos\theta\}.$$

2 Claims, 3 Drawing Sheets

EVAPORATE PATTERN CASTING METHOD

CROSS-REFERENCE TO RELATED APPLICATIONS

This is a national phase application in the United States of International Patent Application No. PCT/JP2015/079474 with an international filing date of Oct. 19, 2015, which claims priority of Japanese Patent Application No. 2014-233403 filed on Nov. 18, 2014 the contents of which are incorporated herein by reference.

TECHNICAL FIELD

The present invention relates to an evaporative pattern casting method for producing a casting.

BACKGROUND ART

In contrast to a common sand-mold casting method, several methods have been proposed to produce a casting with excellent dimensional accuracy. For example, the investment casting method (also called as lost-wax method), the plaster mold casting method, and the evaporative pattern casting method have been developed.

The evaporative pattern casting method is a method for producing a casting by burying into casting sand a mold, which is formed by application of a coating agent to the surface of a foam pattern, and then pouring a metal melt into the mold to cause the foam pattern to disappear and be replaced with the melt.

JP 2011-110577 A discloses an evaporative pattern casting method to set casting time during casting in accordance with a pattern modulus (a pattern volume divided by a pattern surface area).

SUMMARY OF INVENTION

Problems to be Solved by the Invention

When a casting having an internal space is to be made by the common cavity casting method, as shown in FIG. 3 being a side sectional view, a sand mold, which has a shape corresponding to the internal space of the casting and is referred to as a core 24, is disposed in a cavity 23 formed between an upper mold 21 and a lower mold 22. However, as shown in FIG. 4 being a side sectional view, during casting, the core 24 is surrounded by a melt and receives buoyant force in a vertical direction. For this reason, the core 24 is floated unless there is a support portion to support the core 24. The floating of the core 24 leads to production of a casting with a displaced internal space.

Then, as shown in FIG. 5 being a side sectional view, an excess part 25, projecting in a horizontal direction and called a baseboard, is provided in the core 24, and the core 24 is supported by the upper mold 21 and the lower mold 22 through the excess part 25, thereby preventing the core 24 from being floated.

Meanwhile, in the case of the evaporative pattern casting method, the inside of the foam pattern is filled with the casting sand to form the internal space, but the casting sand that fills the inside of the foam pattern cannot be supported by providing a baseboard in a portion out of the product. For this reason, during casting, the casting sand that fills the inside of the foam pattern is surrounded by the melt to cause occurrence of a "floated state" where the casting sand receives buoyant force in the vertical direction and is floated.

Then, as shown in FIG. 6 being a side sectional view, a wide opening portion 17 for communicating between the outside of a foam pattern 12 surrounded by casting sand 15 and the inside of the foam pattern is provided in an upper portion of the foam pattern 12, and a load as large as or larger than the buoyant force is applied to casting sand 16 that fills the inside of the foam pattern 12. This prevents floating of the casting sand 16 that fills the inside of the foam pattern 12. However, when there is a restriction on the shape of the casting to be produced, the wide opening portion 17 cannot be provided in the foam pattern 12, making it impossible to employ the evaporative pattern casting method.

It is an object of the present invention to provide an evaporative pattern casting method capable of preventing floating of casting sand that fills the inside of the foam pattern, to produce a casting in a good finished state.

Means for Solving the Problems

An evaporative pattern casting method according to the present invention is a method for producing a casting by burying into casting sand a mold, which is formed by application of a coating agent to a surface of a foam pattern having a cavity part inside, and then pouring a metal melt into the mold to cause the foam pattern to disappear and be replaced with the melt, and in the method, an opening for communicating between the outside of the mold and the cavity part is provided in the foam pattern, and the coating agent is applied to the opening, and when the coating agent applied to the opening is taken as a beam having a sectional secondary moment I($mm^4$), a vertical plate thickness h(mm), and a length L(mm), selections are made for a sectional shape of the opening, an angle of the opening, and a transverse strength of the coating agent so as to satisfy the following expression, where a volume of the cavity part is V ($mm^3$), a bulk density of the casting sand that fills the cavity part is ρs ($kg/mm^3$), a density of the melt is ρm ($kg/mm^3$), a gravitational acceleraton is g ($mm/sec^2$), an angle of the opening with respect to the vertical direction is θ, and a transverse strength of the coating agent at the highest temperature during pouring of the melt is σb (MPa).

$$\sigma bI > V(\rho m - \rho s)g\{(hL/2)\sin\theta - \cos\theta\}$$

Effect of the Invention

According to the present invention, the opening for communicating the outside of the mold with the cavity part is provided in the foam pattern, and the coating agent is applied to the opening. At the time of casting, the cavity part is supported by the coating agent applied to the opening. When the coating agent at the opening which supports the cavity part is assumed to be a beam having a sectional secondary moment I, a vertical plate thickness h, and a length L, the above expression is derived from the beam theory. Selecting a sectional shape of the opening, an angle of the opening, and a transverse strength of the coating agent so as to satisfy the above expression can keep the coating agent at the opening from being damaged. This can prevent floating of the casting sand that fills the inside of the foam pattern, to thereby produce a casting in a good finished state.

DESCRIPTION OF EMBODIMENTS

Figure 1:
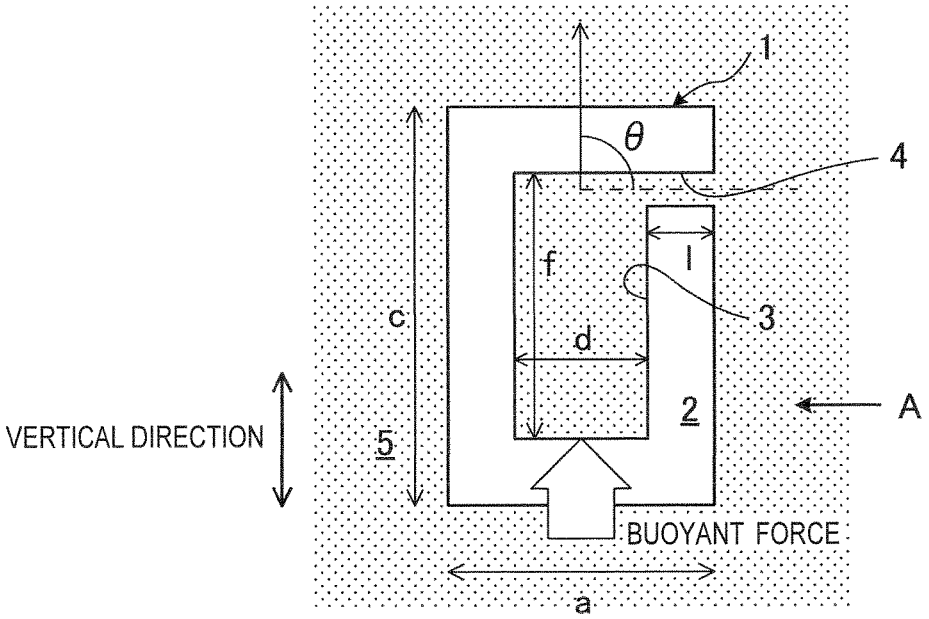
FIG. 1 is a side sectional view of the mold.

A preferred embodiment of the present invention will be described below with reference to the drawings.

(Evaporative Pattern Casting Method)

An evaporative pattern casting method according to an embodiment of the present invention is a method for producing a casting by burying into casting sand (dry sand) a mold, which is formed by application of a coating agent to a surface of a foam pattern having a cavity part inside, and then pouring a metal melt into the mold to cause the foam pattern to disappear and be replaced with the melt. Note that the cavity part in the foam pattern is a cavity portion formed in a product by casting.

The evaporative pattern casting method includes a dissolution step of melting metal (casting iron) into a melt, a shaping step of shaping a foam pattern, and an application step of applying a coating agent to the surface of the foam pattern to obtain a mold. The evaporative pattern casting method then includes a molding step of burying the mold into casting sand to fill every corners of the mold with the casting sand, and a casting step of pouring the melt (melted metal) into the mold to melt and replace the foam pattern with the melt. The evaporative pattern casting method further includes a cooling step of cooling the melt poured into the mold to obtain a casting, and a separation step of separating the casting and the casting sand.

As the metal to be melted into the melt, gray cast iron (JIS-FC250), flake graphite cast iron (JIS-FC300), or the like is usable. As the foam pattern, foam resin such as styrene foam is usable. As the coating agent, a coating agent of a silica-based aggregate or the like is usable. As the casting sand, "silica sand" mainly composed of $SiO_2$, zircon sand, chromite sand, synthesized ceramic sand, or the like is usable. Note that a bonding agent or a curing agent may be added to the casting sand.

A thickness of the coating agent is preferably 3 mm or smaller. This is because, when the thickness of the coating agent is 3 mm or larger, application and drying of the coating agent need to be repeated three times or more, which takes much time and makes the thickness easily become non-uniform.

In the present embodiment, an opening for communicating between the outside of the mold and the cavity part is provided in the foam pattern, the coating agent is applied to the opening, and a sectional shape of the opening, an angle of the opening, and a transverse strength of the coating agent are selected so as to satisfy Expression (1) below.

$$\sigma bI > V(\rho m-\rho s)g\{(hL/2)\sin\theta-\cos\theta\} \quad \text{Expression (1)}$$

where σb is a transverse strength (bending strength) (MPa) of the coating agent at the highest temperature during pouring of the melt, V is a volume of the cavity part, ρs is a bulk density of the casting sand that fills the cavity part, ρm is a density of the melt, g is a gravitational acceleration, and θ is an angle of the opening with respect to a vertical direction. When the coating agent applied to the opening is regarded as a beam, I is a sectional secondary moment, h is a vertical plate thickness (mm), and L is a length (mm) of the beam.

(Strength of Coating Agent)

Figure 2:
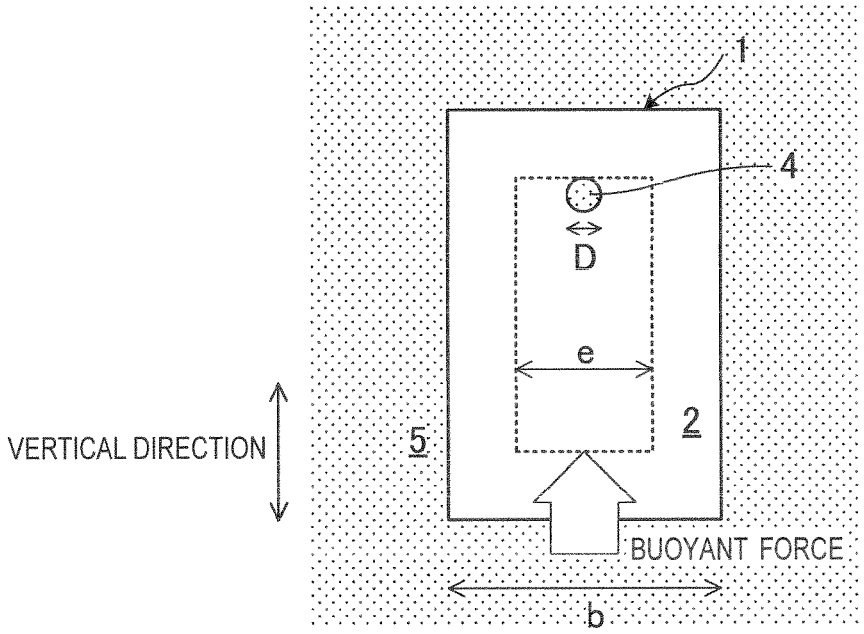
FIG. 2 is a side view of FIG. 1 seen from a direction A.
Figure 3:
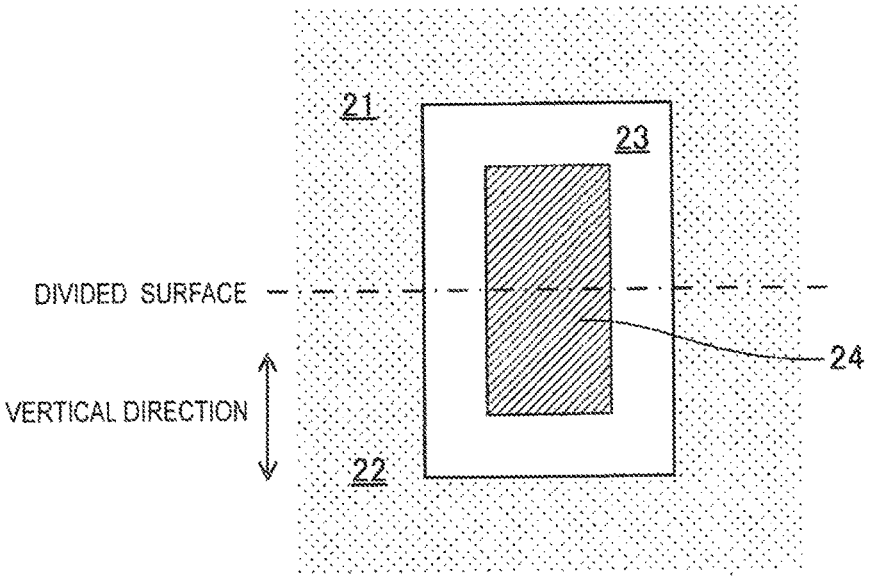
Fig.3 PRIOR ART
FIG. 3 is a side sectional view in a cavity casting method.
Figure 4:
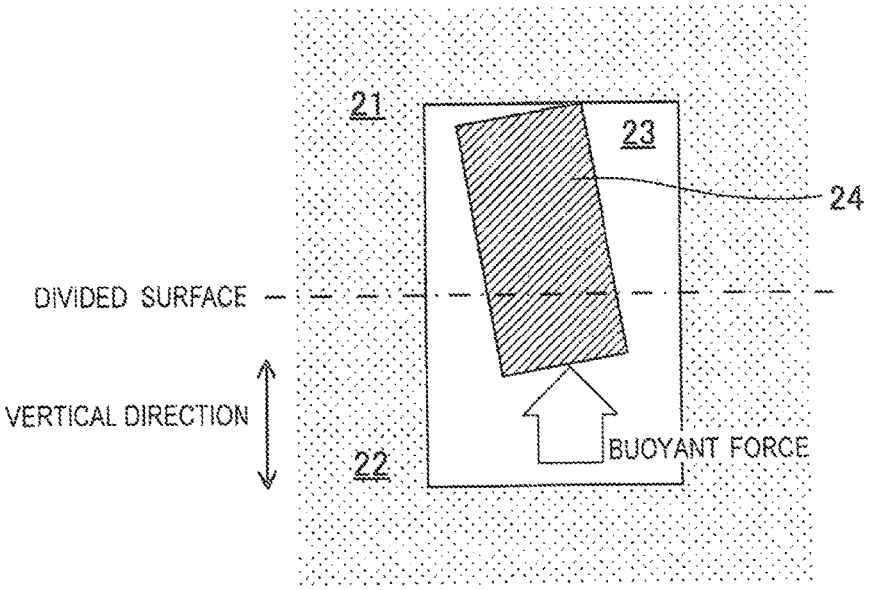
Fig.4 PRIOR ART
FIG. 4 is a side sectional view in the cavity casting method.
Figure 5:
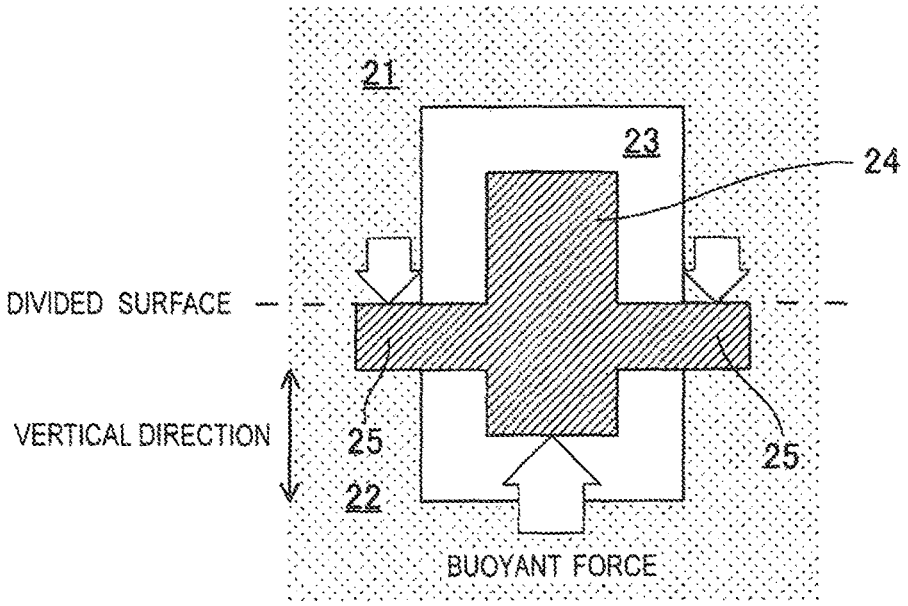
Fig.5 PRIOR ART
FIG. 5 is a side sectional view in the cavity casting method.
Figure 6:
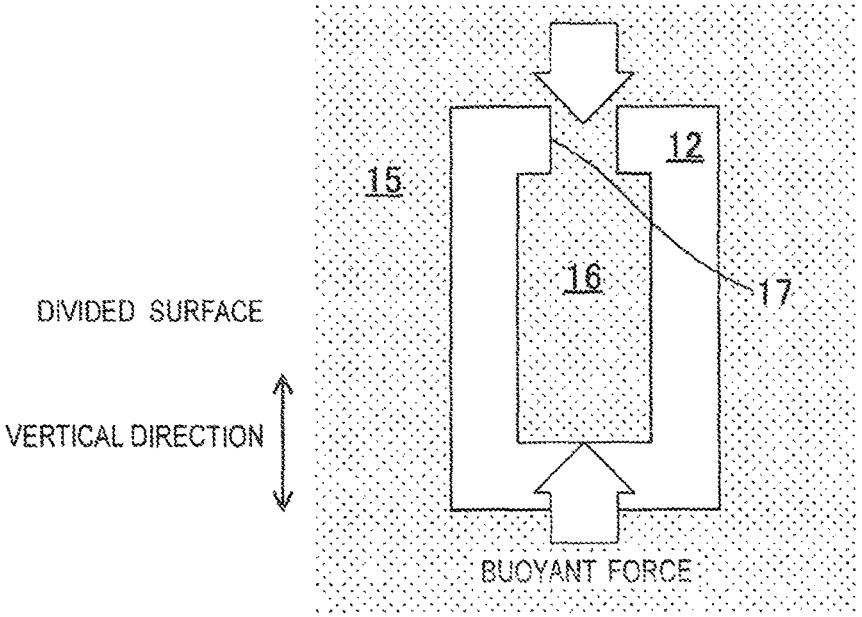
Fig.6 PRIOR ART
FIG. 6 is a side sectional view in an evaporative pattern casting method.

FIG. 1 is a side sectional view of the mold, and FIG. 2 is a side view of FIG. 1 seen from a direction A. As shown in FIGS. 1 and 2, there will be considered the case of producing a casting that includes a cavity part 3 inside by using a mold 1 in which an opening 4 for communicating between the cavity part 3 and the outside of a foam pattern 2, having the cavity part 3 inside and being in a rectangular parallelepiped shape, is provided in a horizontal direction (θ=90°) in the foam pattern 2. The foam pattern 2 has a width a (mm), a depth b (mm), and a height c (mm). The cavity part 3 has a width d (mm), a depth e (mm), and a height f (mm). The opening 4 has a diameter D (mm) and a length 1 (mm). The mold 1 is surrounded and covered with casting sand 5. Note that the shape of the foam pattern 2 is not restricted to the rectangular parallelepiped.

First, from the Archimedes' principle, buoyant force F which acts on the cavity part 3 is obtained by Expression (2) below.

$$F=V(\rho m-\rho s)g \quad \text{Expression (2)}$$

At the time of casting, the cavity part 3 is supported by the coating agent applied to the opening 4. The coating agent at the opening 4 which supports the cavity part 3 is assumed to be a beam having a sectional secondary moment I, a vertical plate thickness h, and a length L. When the maximum stress σmax of a cantilever, the edge of which is acted on by the buoyant force F, is calculated using the beam theory, it is estimated as in Expression (3) below. Note that this is premised on that the sand in the opening 4 bears no load.

$$\sigma\max=M/I\times h/2=hFL/2I=hV(\rho m-\rho s)g\ L/2I \quad \text{Expression (3)}$$

Assuming the transverse strength (hot strength) of the coating agent at the highest temperature during pouring of the melt is σb, when Expression (4) below holds, it is possible to keep the coating agent at the opening 4 from being damaged, namely to prevent occurrence of a "floated state" where the sand that fills the cavity part 3 is floated.

$$\sigma b>\sigma\max \quad \text{Expression (4)}$$

Substituting Expression (3) into Expression (4) gives Expression (5).

$$\sigma bI>hV(\rho m-\rho s)g\ L/2 \quad \text{Expression (5)}$$

For example, when the opening 4 is formed in a cylindrical shape, the coating agent becomes a layer in the shape of a circular tube. Assuming that a diameter of the cylinder of the opening 4 is D and a thickness of the coating agent is t, the sectional secondary moment I is expressed by Expression (6) below. Further, the vertical plate thickness h is expressed by Expression (7) below.

$$I=\pi\{D^4-(D-2t)^4\}/64 \quad \text{Expression (6)}$$

$$h=D \quad \text{Expression (7)}$$

Then, there may be selected a coating agent having the hot strength σb, with which Expression (5) holds when respective values obtained from Expressions (6) and (7) are substituted into Expression (5).

(Sectional Shape of Opening)

Modifying Expression (5) gives Expression (8).

$$I>hV(\rho m-\rho s)g\ L/2\sigma b \quad \text{Expression (8)}$$

The sectional shape of the opening 4 is then designed such that the sectional secondary moment I satisfies Expression (8), thereby enabling prevention of the "floated state" from occurring.

(Angle of Opening)

The opening 4 described above is provided in the horizontal direction (θ=90°). When the opening 4 is provided in the horizontal direction (θ=90°), the stress that acts on the coating agent at the opening 4 becomes maximal. However, changing the angle of the opening 4 can reduce the stress σmax that acts on the coating agent at the opening 4. When it is assumed that the angle of the opening 4 with respect to the vertical direction is θ (0°≤θ≤180°) and the coating agent at the opening 4 is a beam, an axial component Fa of the buoyant force is as in Expression (9) below, and a right—angled component Fv thereof is as in Expression (10) below.

$$Fa=F\cos\theta \qquad \text{Expression (9)}$$

$$Fv=F\sin\theta \qquad \text{Expression (10)}$$

When a sectional area of the coating agent at the opening 4 is assumed to be A and the maximum stress σmax of a cantilever, the edge of which is acted on by the buoyant force F, is calculated using the beam theory, it is estimated as in Expression (11) below.

$$\sigma\max=M/I\times h/2-Fa=hFvL/2I-Fa=V(\rho m-\rho s)g\{(hL/2I)\sin\theta-\cos\theta\} \qquad \text{Expression (11)}$$

Substituting Expression (11) into Expression (4) gives Expression (12).

$$\sigma bI>V(\rho m-\rho s)g\{(hL/2)\sin\theta-\cos\theta\} \qquad \text{Expression (12)}$$

Selecting the sectional shape of the opening 4, the angle θ of the opening 4, and the transverse strength σb of the coating agent so as to satisfy Expression (12) can keep the coating agent at the opening 4 from being damaged.

For example, when the sectional shape and the angle θ of the opening 4 have been fixed, by using the coating agent with the transverse strength σb satisfying Expression (12), it is possible to keep the coating agent at the opening 4 from being damaged. When the transverse strength σb of the coating agent has been fixed, by designing the sectional shape and the angle θ of the opening 4 such that the sectional secondary moment I satisfies Expression (12), it is possible to keep the coating agent at the opening 4 from being damaged.

EXAMPLE

Subsequently, a cavity part in the rectangular parallelepiped shape was provided inside a foam pattern in the rectangular parallelepiped shape by using the gray cast iron (JIS-FC250) as a melt, and a casting was produced by using a mold provided with an opening having a diameter D of 16 mm and a length 1 of 25 mm in the horizontal direction (θ=90°). The foam pattern had a width a of 100 mm, a depth b of 100 mm, and a height c of 200 mm in FIGS. 1 and 2. The cavity part had a width d of 50 mm, a depth e of 50 mm, and a height f of 100 mm. The gray cast iron had a density ρm of $7.1\times10^{-6}$ kg/mm$^3$. Table 1 shows types of the coating agent.

TABLE 1

| Coating agent | Bulk density ρc (g/cm$^3$) | Normal-temperature transverse strength TSc' (MPa) | Aggregate grain size (×100 μm) |
|---|---|---|---|
| A | 1.3-1.5 | >1.5 | 1 |
| B | 2.8-3.0 | >4.4 | 0.9 |

The cavity part was filled with "furan self-hardening sand." This "furan self-hardening sand" is obtained by kneading sand, resin, and a curing agent. The sand used for the self-hardening sand is silica sand (mainly composed of $SiO_2$). The resin used as a bonding agent for the self-hardening sand is an acid-curing furan resin containing furfuryl alcohol, and an additive amount thereof with respect to the sand is 0.8%. The curing agent used as a curing catalyst for the self-hardening sand is a curing agent for furan resin obtained by mixing a xylene sulfonate-based curing agent and a sulfuric acid-based curing agent, and an additive amount thereof with respect to the furan resin is 40%. This self-hardening sand had a bulk density ρs of $1.4\times10^{-6}$ kg/mm$^3$.

Substituting the density of the gray cast iron and the bulk density of the self-hardening sand into Expression (2) gives the following.

$$F=V(\rho m-\rho s)g=50\times50\times100\times(7.1-1.4)\times(10^{-6}\text{kgf})=1.4\text{ kgf}=14N$$

At this point, two coats of the coating agent having an unknown hot strength σb were put to make an average thickness of the coating agent become 0.8 mm. Note that directly measuring the hot strength of the coating agent is difficult. Substituting the above value into Expression (6) gives the sectional secondary moment I of the coating agent at the opening as follows.

$$I=\pi\{16^4-(16-2\times0.8)^4\}/64=1.1\times10^3$$

The right side of Expression (3) becomes as follows.

$$hV(\rho m-\rho s)g\,L/2I=8\times14\times25/(1.1\times10^3)=2.5\text{ MPa}$$

The hot strength of the coating agent (the transverse strength of the coating agent at the highest temperature during pouring of the melt) is usually smaller than the normal-temperature transverse strength (the transverse strength of the coating agent which was measured after drying the coating agent). Thus, for preventing the "floated state", there may be selected a coating agent with a normal-temperature transverse strength being higher than 2.5 MPa that is the hot strength. A coating agent A was not employed because it does not satisfy Expression (5). A coating agent B was selected because its normal-temperature transverse strength is higher than 2.5 MPa. This allowed production of a casting free of the "floated state".

(Effect)

As described above, in the evaporative pattern casting method according to the present embodiment, the opening 4 for communicating between the outside of the mold 1 and the cavity part 3 is provided in the foam pattern 2, and the coating agent is applied to the opening 4. At the time of casting, the cavity part 3 is supported by the coating agent applied to the opening 4. When the coating agent at the opening 4 which supports the cavity part 3 is assumed to be the beam having the sectional secondary moment I, the vertical plate thickness h, and the length L, Expression (12) above is derived from the beam theory. Selecting the sectional shape of the opening 4, the angle of the opening 4, and the transverse strength of the coating agent so as to satisfy Expression (12) above can keep the coating agent at the opening 4 from being damaged. This can prevent floating of the casting sand that fills the inside of the foam pattern 2, to thereby produce a casting in a good finished state.

Further, setting the angle θ of the opening 4 with respect to the vertical direction to 90° maximizes the stress that acts on the coating agent at the opening 4. However, even in this case, selecting the sectional shape of the opening 4 and the transverse strength of the coating agent so as to satisfy Expression (5) above can keep the coating agent at the opening 4 from being damaged.

Although the embodiment of the present invention has been described above, it has merely illustrated a specific example and does not particularly restrict the present invention, and a specific configuration and the like can be changed in design as appropriate. The actions and effects described in the embodiment of the invention are merely a list of the most preferable actions and effects provided by the present invention, and the actions and effects of the present invention are not restricted to those described in the embodiment of the present invention.

The invention claimed is:

1. An evaporative pattern casting method for producing a casting by burying into casting sand a mold, which is formed by application of a coating agent to a surface of a foam pattern having a cavity part inside, and then pouring a metal melt into the mold to cause the foam pattern to disappear and be replaced with the melt, wherein an opening for communicating between the outside of the mold and the cavity part is provided in the foam pattern, and the coating agent is applied to the opening, and when the coating agent applied to the opening is taken as a beam having a sectional secondary moment I ($mm^4$), a vertical plate thickness h (mm), and a length L (mm), selections are made for a sectional shape of the opening, an angle of the opening, and a transverse strength of the coating agent so as to satisfy the following expression, where a volume of the cavity part is V ($mm^3$), a bulk density of the casting sand that fills the cavity part is ρs ($kg/mm^3$), a density of the melt is ρm ($kg/mm^3$), a gravitational accelaration is g ($mm/sec^2$), an angle of the opening with respect to the vertical direction is θ, and a transverse strength of the coating agent at the highest temperature during pouring of the melt is σb (MPa)

$$\sigma bI > V(\rho m - \rho s)g\{(hL/2)\sin\theta - \cos\theta\}.$$

2. The evaporative pattern casting method according to claim 1, wherein the angle θ of the opening with respect to the vertical direction is 90°.

* * * * *